US007636066B2

(12) United States Patent
Fujimoto et al.

(10) Patent No.: US 7,636,066 B2
(45) Date of Patent: Dec. 22, 2009

(54) COMPOUND ANTENNA APPARATUS

(75) Inventors: Shingo Fujimoto, Tokai (JP); Eiji Koide, Takahama (JP); Hideaki Takahashi, Chiryu (JP); Kazunari Saito, Katagami (JP)

(73) Assignees: Aisin Seiki Kabushiki Kaisha, Aichi-ken (JP); Mitsumi Electric Co., Ltd, Tokyo (JP)

( * ) Notice: Subject to any disclaimer, the term of this patent is extended or adjusted under 35 U.S.C. 154(b) by 290 days.

(21) Appl. No.: 11/723,538

(22) Filed: Mar. 20, 2007

(65) Prior Publication Data

US 2007/0290943 A1 Dec. 20, 2007

(30) Foreign Application Priority Data

Mar. 20, 2006 (JP) ..... 2006-076960

(51) Int. Cl.
*H01Q 1/32* (2006.01)

(52) U.S. Cl. ..... 343/713

(58) Field of Classification Search ..... 343/711–713, 343/702, 700 MS, 872
See application file for complete search history.

(56) References Cited

U.S. PATENT DOCUMENTS 5,907,304 A * 5/1999 Wilson et al. ..... 343/700 MS
6,380,902 B2 * 4/2002 Duroux ..... 343/713
6,445,358 B2 * 9/2002 Takahashi et al. ..... 343/828
6,727,853 B2 * 4/2004 Sasada et al. ..... 343/700 MS
6,870,510 B2 * 3/2005 Raddant et al. ..... 343/711
6,900,774 B2 * 5/2005 Kawakami et al. ..... 343/841
7,283,100 B2 * 10/2007 Thompson et al. ..... 343/713
7,427,963 B2 * 9/2008 Moriya ..... 343/788
2006/0114161 A1 * 6/2006 Yamaguchi ..... 343/713
2006/0244667 A1 * 11/2006 Thompson et al. ..... 343/713

FOREIGN PATENT DOCUMENTS

JP 2004-56773 A 2/2004

* cited by examiner

*Primary Examiner*—Huedung Mancuso
(74) *Attorney, Agent, or Firm*—Sughrue Mion, PLLC

(57) ABSTRACT

A compound antenna apparatus includes a plurality of antenna units, a top case covering the antenna units, and a cable connected to one of the antenna units and led out of the top case, wherein the top case includes a case main surface, a case wall portion standing in the vicinity of an edge of the case main surface; and an opening formed by cutting an edge of the case wall portion so that the cable is pulled out to an exterior portion of the top case through the opening, and the opening having one surface and the other surface that face each other, a first rib and a second rib respectively formed and protruding at the surface and the other surface of the opening so as to sandwich the cable.

12 Claims, 7 Drawing Sheets

COMPOUND ANTENNA APPARATUS

CROSS REFERENCE TO RELATED APPLICATIONS

This application is based on and claims priority under 35 U.S.C §119 with respect to Japanese Patent Application 2006-076960, filed on Mar. 20, 2006, the entire content of which is incorporated herein by reference.

FIELD OF THE INVENTION

This invention relates to a compound antenna apparatus having multiple antennas.

BACKGROUND

In a technical field related to such antennas, as is generally known, various types of antennas are mounted to a vehicle. For example, a GPS (Global Positioning System) antenna, an ETC (Electronic Toll Collection System) antenna, a VICS (Vehicle Information and Communication System) antenna, a telephone antenna and the like are mounted to the vehicle.

Specifically, the GPS (Global Positioning System) employs a satellite positioning system by use of a satellite. The GPS receives electric waves such as GPS signals from four satellites out of twenty-four earth-orbiting satellites. By measuring a positional relation and a time error between a movable body on the earth and the satellite, on the basis of the principle of the trigonometrical survey, the GPS computes a position and an altitude of the movable body on a map or the like with high accuracy.

The GPS is used for a car navigation system or the like for detecting a position of a running vehicle, and such system has been widely used. A car navigation device includes a GPS antenna, a processing device, a displaying device and the like. Specifically, the GPS antenna receives the GPS signal from the satellite, the processing device detects a current position of the running vehicle by processing the received GPS signal, and the display device displays the detected current position of the running vehicle on a map or the like.

The ETC (Electronic Toll Collection) is a system which was developed for easing traffic jams at tollgates, at which a passenger pays a toll for an expressway. Specifically, the ETC is a system by which the toll is automatically paid by the passenger at the tollgate by means of a wireless communication system. More specifically, the vehicle equipped with a communicating device having an ETC antenna two-way communicates with an antenna provided at the tollgate in order to receive information from the vehicle, and the toll can be paid automatically at the tollgate without requiring the vehicle to stop.

A known compound antenna apparatus equipped with the GPS antenna, the VICS (Vehicle Information and Communication System) antenna and the ETC antenna is disclosed in JP2004-56773A.

In the known compound antenna apparatus disclosed in JP2004-56773A, the GPS antenna and the VICS antenna are mounted to a circuit board, and the ETC antenna is independently mounted to the vehicle as a sub assembly. That is, when those antennas are mounted to the vehicle, a direction of the ETC antenna can be controlled separately from that of the GPS antenna and the VICS antenna because directional characteristics of the ETC antenna differs from that of the GPS antenna and the VICS antenna.

In the known compound antenna apparatus disclosed in JP2004-56773A, the cables connected to the antennas are pulled out from the apparatus, however, tensile strength of the cables in the direction in which the cables are pulled out is not considered. Thus, resulting in low tensile strength in the direction where the cables are pulled.

In the compound antenna apparatus, the cables may be fixed to brackets by lock bands in order to maintain the tensile strength of the cables. However, a large space is required to fix the cables by means of the lock bands and the brackets, and the number of components and man-hours increase.

The present invention has been made in view of the above circumstances, and provides a compound antenna apparatus enabling improvement of the tensile strength, reduction in the number of the components and the man-hours and space saving.

SUMMARY OF THE INVENTION

According to an aspect of the present invention, a compound antenna apparatus includes a plurality of antenna units, a top case covering the antenna units, and a cable connected to one of the antenna units and led out of the top case, wherein the top case includes a case main surface, a case wall portion standing in the vicinity of an edge of the case main surface, and an opening formed by cutting an edge of the case wall portion so that the cable is pulled out to an exterior portion of the top case through the opening, and the opening having one surface and the other surface that face each other, a first rib and a second rib respectively formed and protruding at the surface and the other surface of the opening so as to sandwich the cable.

BRIEF DESCRIPTION OF THE DRAWINGS

The foregoing and additional features and characteristics of the present invention will become more apparent from the following detailed description considered with reference to the accompanying drawings, wherein:

FIG. 4A is a perspective view viewed from a front right direction, FIG. 4B is a plain view, FIG. 4C is a front view (elevation view), FIG. 4D is a left lateral view, FIG. 4E is a right lateral view, FIG. 4F is a rear view (back view), and FIG. 4G is a bottom view;

DETAILED DESCRIPTION

An embodiment of the present invention will be explained in detail in accordance with the attached drawings.

Figure 1:
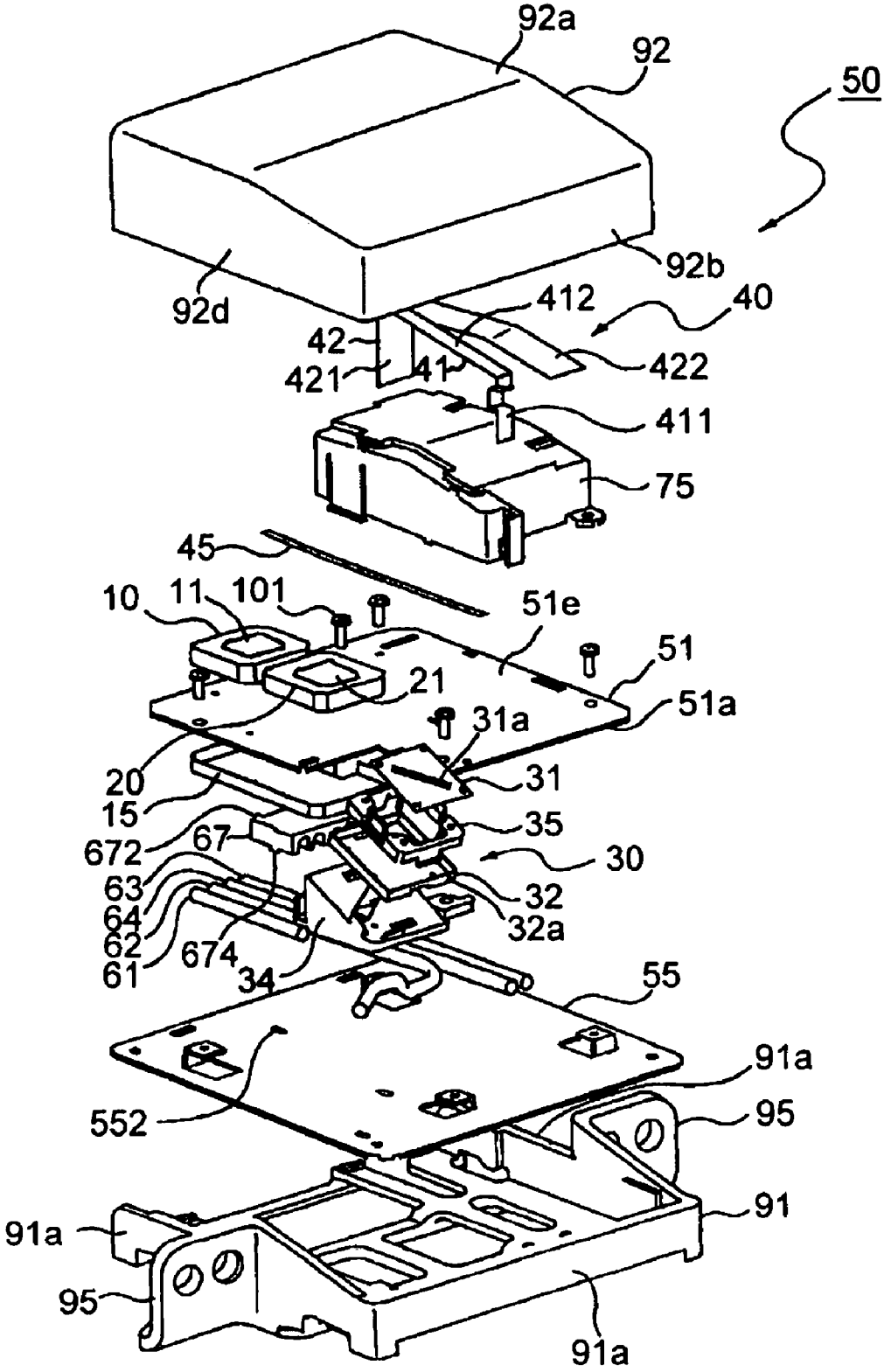
FIG. 1 is an exploded perspective view of a compound antenna apparatus to which the present invention is applied viewed from a front right direction.
Figure 2:
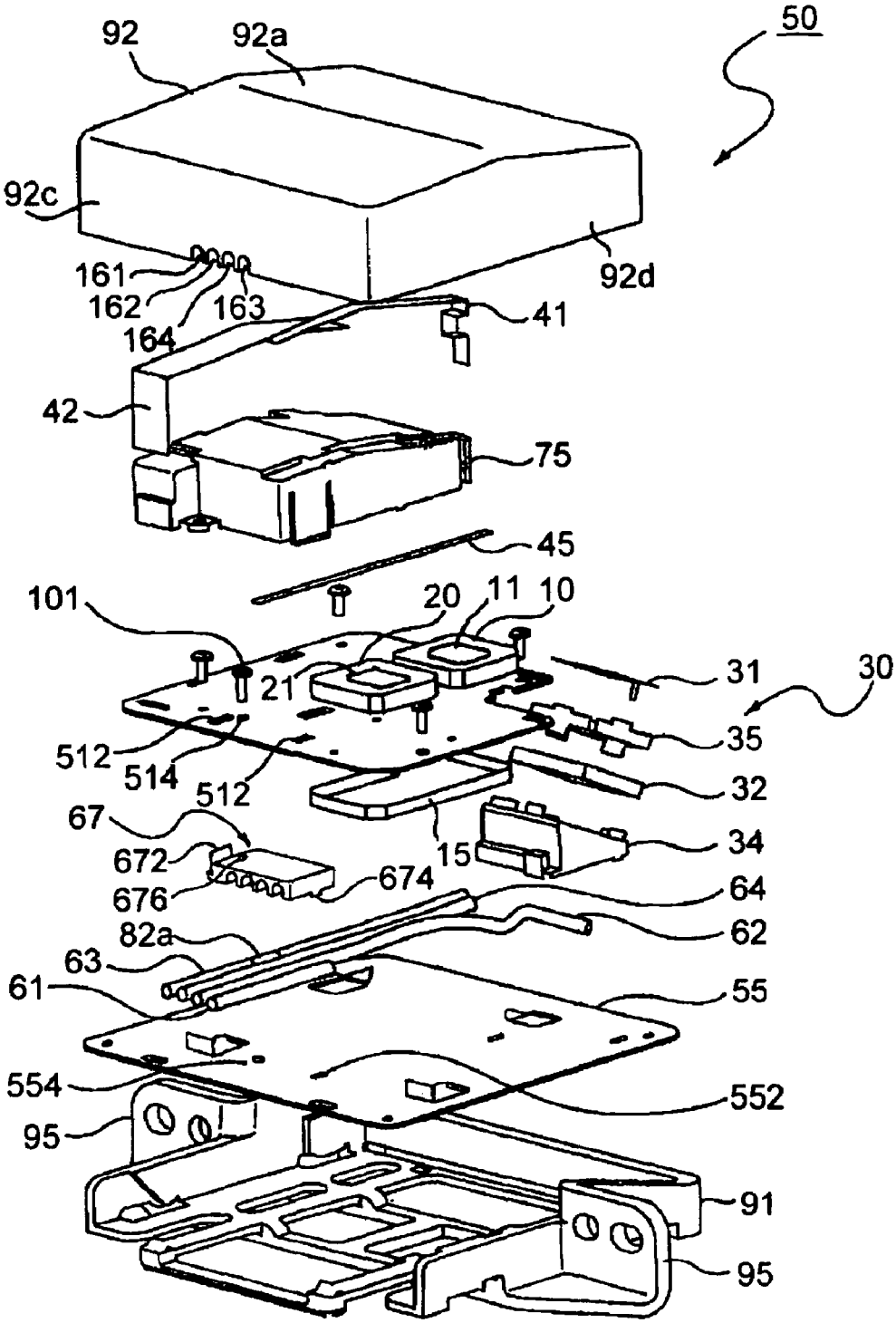
FIG. 2 is an explodes perspective view of the compound antenna apparatus shown in FIG. 1 viewed from a rear right direction.
Figure 3:
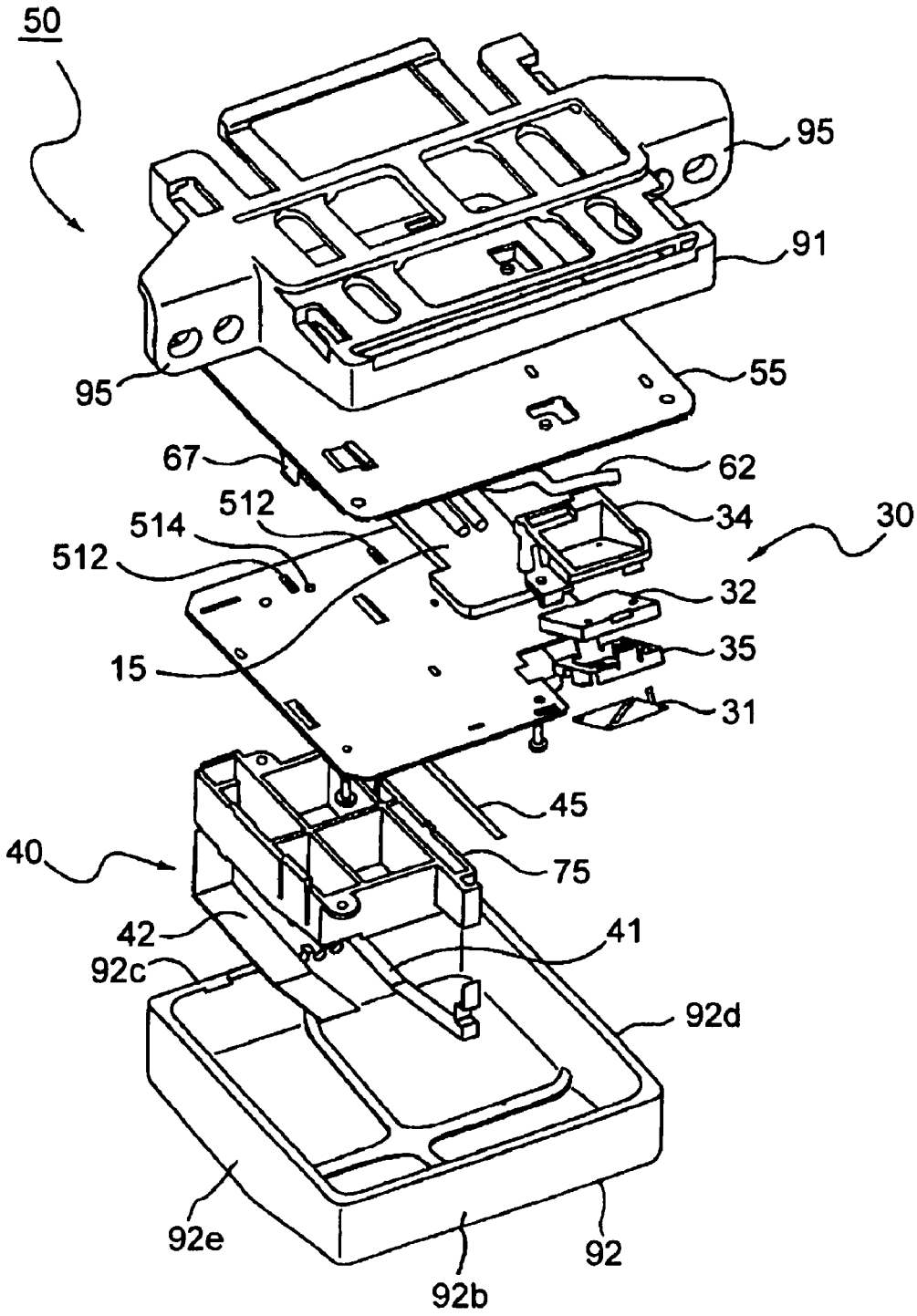
FIG. 3 is an exploded perspective view of the compound antenna apparatus shown in FIG. 1 viewed from a bottom side.
Figure 4F:
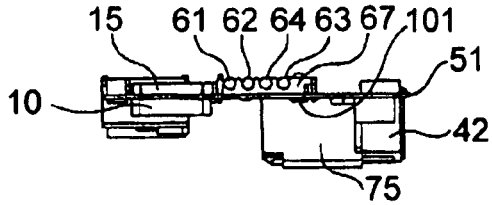
FIGS. 4A, 4B, 4C, 4D, 4E, 4F and 4G illustrate the compound antenna apparatus 50 shown in FIG. 1 through FIG. 3 from which a top case, a bottom case and a ground plane are removed.
Figure 4B:
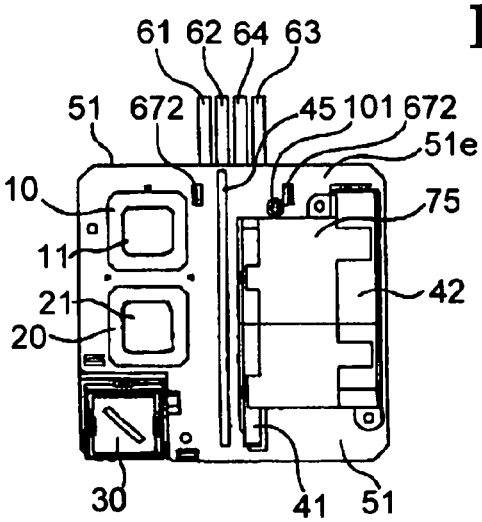
Figure 4D:
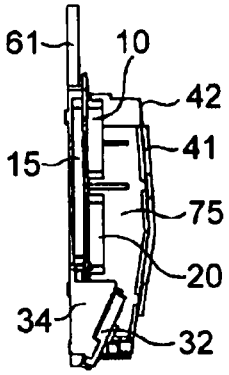
Figure 4E:
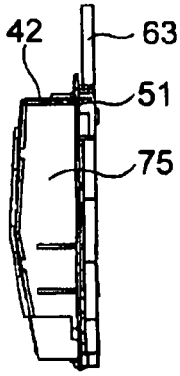
Figure 4C:
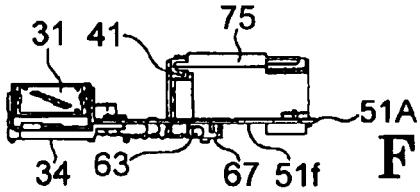
Figure 4A:
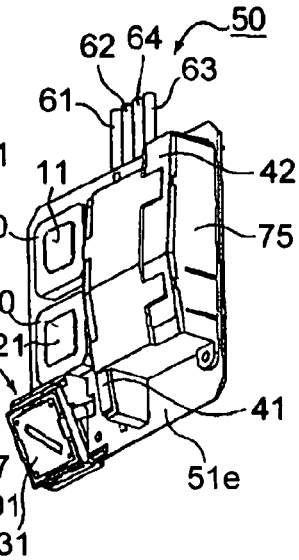
Figure 4G:
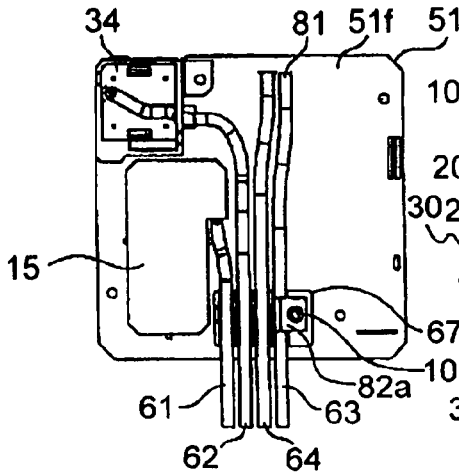

FIGS. 1 to 4 illustrate diagrams indicating the compound antenna apparatus 50 to which the present invention is applied. Specifically, FIG. 1 illustrates an exploded perspective view of the compound antenna apparatus 50 seen from a front right direction, FIG. 2 illustrates an exploded perspective view of the compound antenna apparatus 50 seen from a rear right direction, and FIG. 3 illustrates an exploded perspective view of the compound antenna apparatus 50 seen from the bottom.

FIG. 4 illustrates a diagram indicating the compound antenna apparatus 50 illustrated in FIG. 1 through FIG. 3 from which a top case, a bottom case and a ground plane are removed. Specifically, FIG. 4A illustrates an exploded perspective view of the compound antenna apparatus 50 seen from a front right direction, FIG. 4B illustrates a flat view of the compound antenna apparatus 50, FIG. 4C illustrates a front view (elevation view) of the compound antenna apparatus 50, FIG. 4D illustrates a left side view of the compound antenna apparatus 50, FIG. 4E illustrates a right side view of the compound antenna apparatus 50, FIG. 4F illustrates a rear view (back view) of the compound antenna apparatus 50, and FIG. 4G illustrates a bottom plan view of the compound antenna apparatus 50.

Referring to FIGS. 1 to 4, the compound antenna apparatus 50 includes a main circuit board 51 and a ground plane (ground plate) 55. Specifically, a first antenna unit 10, a second antenna unit 20, a third antenna unit 30 and a fourth antenna unit 40 are mounted on the main circuit board 51.

In this example illustrated in the drawings, the first antenna unit 10 is a GPS antenna, the second antenna unit 20 is a VICS antenna, the third antenna unit 30 is an ETC antenna, and the fourth antenna unit 40 is a telephone antenna.

The first antenna unit 10 includes a first antenna element 11 and a LNA (Low Noise Amplifier) circuit (not shown) connected to the first antenna element 11. In the example illustrated in the drawings, the first antenna element 11 is comprised of a patch antenna.

The second antenna unit 20 is provided at a different position than the first antenna unit 10. The second antenna unit 20 includes a second antenna element 21 and a filter circuit (not shown) connected to the second antenna element 21. In the example illustrated in the drawings, similarly to the first antenna element 11, the second antenna element 21 is also comprised of a patch antenna.

A signal received by the first antenna element 11 and output via the LNA circuit and a signal received by the second antenna element 21 and output via the filter circuit are combined by means of a duplexer (not shown) so as to be a composite signal, and the composite signal is transmitted via the first output cable 61 to a signal processing device (not shown).

The third antenna unit 30 is positioned on a main surface 51*e* of the main circuit board 51 at a side of a front edge 51*a* of the main circuit board 51. The third antenna unit 30 is located in a position where is lower than the positions of the first and second antenna elements 11 and 21. Thus, the third antenna unit 30 does not interrupt the first and the second antenna units 10 and 20 to receive the signals. Further, third antenna unit 30 is positioned so as to be tilted at a predetermined angle relative to the main surface 51*e* of the main circuit board 51.

More specifically, the third antenna unit 30 includes a third antenna element 31, a ground plane 32 positioned so as to be parallel to the third antenna element 31, a base 34 to which the ground plane 32 is mounted, and a spacer 35 provided between the third antenna element 31 and the ground plane 32. The base 34 is attached to the main circuit board 51 by means of a screw and also is mounted to the ground plane 55.

The ground plane 32 includes a wall portion 32*a* vertically standing at a peripheral edge of the ground plane 32 and extending toward the third antenna element 31 so as to enclose the third antenna element 31. Height of the wall portion 32*a* is set to be practically equal to or lower than a distance between the third antenna element 31 and the ground plane 32. A spacer (not shown) having a feeding conductor (not shown) is provided between the third antenna element 31 and the ground plane 32. The third antenna element 31 is made of a metal plate formed in a rectangle shape, and a long hole 31*a* is formed on the third antenna element 31 so as to extend along one of diagonal lines of the third antenna element 31.

The signal received by the third antenna element 31 is transmitted via a coaxial second output cable 62 to an external circuit (not shown). To elaborate, a central conductor (internal conductor) of the second output cable 62 is connected to one end of the feeding conductor, and an external conductor of the second output cable 62 is connected to the ground plane 32.

The fourth antenna unit 40 is comprised of a strip-shaped feed element 41 and a strip shaped passive element 42. The passive element 42 is positioned so as to be parallel to the feed element 41. In the example illustrated in the drawings, the feed element 41 is comprised of an inverted L element, and the passive element 42 is comprised of a parasitic element.

The feed element 41 and the passive element 42 are held by an antenna holder 75. The antenna holder 75 with those elements 41 and 42 is mounted to the main surface 51*e* of the main circuit board 51.

The fourth antenna unit 40 further includes a sub antenna 45. The sub antenna 45 may be comprised of a conductive pattern formed on the main surface 51*e* of the main circuit board 51. A signal received by the sub antenna 45 is transmitted to an external circuit (not shown) via a coaxial fourth output cable 64.

The feed element 41 has a vertical portion 411 and a horizontal portion 412. The vertical portion 411 extends from the main surface 51*e* of the main circuit board 51 in a vertical direction at a side of the front edge 51*a*. The horizontal portion 412 extends from a tip of the vertical portion 411 in a horizontal direction being substantively parallel to the main surface 51*e* of the main circuit board 51. The vertical portion 411 has a rectangular portion which is shaped by bending a part of the vertical portion 411 inwardly in a substantively parallel direction to the horizontal portion 412, and thus length of the vertical portion 411 is shortened. In the example illustrated in the drawings, a front portion of the horizontal portion 412, which located at the front edge 51*a* side, inclines toward the main surface 51*e* of the main circuit board 51 for fitting into a shape of the below-described top case.

The passive element 42 has a vertical portion 421 and a horizontal portion 422. The vertical portion 421 vertically extends from the main surface 51*e* of the main circuit board 51 at a distal side of the horizontal portion 412 of the feed element 41 and the horizontal portion 422 extends from a tip of the vertical portion 421 in a horizontal direction being substantively parallel to the main surface 51*e* of the main circuit board 51. In the example illustrated in the drawing, a front portion of the horizontal portion 422, which is located at the front edge 51*a* side of the main circuit board 51, inclines toward the main surface 51*e* of the main circuit board 51 for fitting into the shape of the below-described top case.

Further, plural holder fixing portions 79 are formed at the antenna holder 75. The antenna holder 75 is fixed to the main circuit board 51 by means of a screw 101 screwed into the holder fixing portion 79.

A ground pattern (not shown) is formed on a bottom surface of the main circuit board 51. Thus, the main circuit board 51 also functions as a ground plate. A point of the main surface 51*e* of the main circuit board 51 with which the inverted L element 41 contacts is a feed point and an internal conductor (central conductor) which is not shown, of the coaxial third output cable 63 is connected to the feed point. Further, an external conductor of the third output cable 63, which is not shown, is electrically connected and grounded to the ground pattern formed on the bottom surface of the main circuit board 51 by means of soldering at the feed point. In this configuration, the third output cable 63 includes a first grounded portion 81 at the feed point.

Further, in the compound antenna apparatus 50, the plate spring 82*a* is wounded around an exposed portion of the external conductor of the third output cable 63, and the plate spring 82*a* is fixed on the main circuit board 51 together with the third output cable 63 by means of a screw. Thus, third output cable 63 is electrically connected and grounded to the ground pattern formed on the bottom surface of the main circuit board 51.

Furthermore, in the compound antenna apparatus 50, a metal member for grounding (not shown) may be used alternatively. Specifically, the metal member is wounded around the exposed portion of the external conductor of the third output cable 63, and the metal member is fixed on the main circuit board 51 together with the third output cable 63 by means of caulking. Thus, the third output cable 63 is electrically connected and grounded to the ground pattern formed on the bottom surface of the main circuit board 51.

In the compound antenna apparatus 50, the first through fourth output cables 61 to 64 are distributed on the bottom surface 51*f* of the main circuit board 51. The first through fourth output cables 61 to 64 are held by a cable holder 47 attached on the bottom surface 51*f* of the main circuit board 51. Thus, the first through fourth output cables 61 to 64 are provided between the main circuit board 51 and the ground plane 55.

In the compound antenna apparatus 50, the LNA (Low Noise Amplifier) circuit (not shown) of the first antenna unit 10 and the filter circuit (not shown) of the second antenna unit 20 are mounted on the bottom surface 51*f* of the main circuit board 51. The LNA circuit and the filter circuit are covered by a shielding case 15 provided on the bottom surface 51*f* of the main circuit board 51.

The compound antenna apparatus 50 further includes a bottom case 91 to which the main circuit board 51 is mounted. The bottom case 91 is formed in a rectangular shape so as to be slightly larger than the main circuit board 51.

The compound antenna apparatus 50 further includes a top case 92 covering the first through fourth antenna units 10, 20, 30 and 40. The top case 92 may be called a radome.

The top case 92 includes a case main surface 92*a* and first, second, third, and fourth case wall portions 92*b*, 92*c*, 92*d*, and 92*e*. The case main surface 92*a* corresponds to a holder main surface 75*a* of the antenna holder 75, and the first, second, third, and fourth case wall portions 92*b*, 92*c*, 92*d* and 92*e* vertically stand at the peripheral edges of the case main surface 92*a*. Also, the first, second, third, and fourth case wall portions 92*b*, 92*c*, 92*d* and 92*e* may stand in the vicinity of the peripheral edges of the case main surface 92*a*. In this configuration, the first through fourth antenna units 10, 20, 30, and 40 are housed into the bottom case 91 and the top case 92.

The first case wall portion 92*b* corresponds to the front edge 51*a* of the main circuit board 51. The second case wall portion 92*c* faces the first case wall portion 92*b*. The third and fourth case wall portions 92*d* and 92*e* face each other and connect the first case wall portion 92*b* to the second case wall portion 92*c*. The compound antenna apparatus 50 configured as above is mounted to a dashboard inside of a vehicle or the likes so that the front edge 51*a* of the main circuit board 51 is located at a front portion of the compound antenna apparatus 50.

Further, first, second, third and fourth openings 161, 162, 163, and 164 are formed at the second case wall portion 92*c* of the top case 92. The first, second, third, and fourth openings are used for pulling out the respective output cables 61 to 64 to an exterior portion of the top case 92. The first to fourth openings 161, 162, 163, and 164 are formed by cutting an edge of the second case wall portion 92*c* into grooves.

The bottom case 91 includes wall portions 91*a* vertically standing so as to surround an outer peripheral surface of the top case 92 except a rear edge of the bottom case 91. A pair of brackets 95 is attached to each of left and right sides of the wall portions 91*a* of the bottom case 91. The compound antenna apparatus 50 is attached in the dashboard inside of the vehicle or the like by means of the pair of the brackets 95. Alternatively, the compound antenna apparatus 50 is embedded within a packet tray (at rear). Thus, the compound antenna apparatus 50 is easily attached to the vehicle by means of the brackets 95.

Next, fixation structure of the second grounded portion of the third output cable 63 in the compound antenna apparatus 50 will described with reference to FIGS. 5 and 6.

The cable holder 67 has first, second, third, and fourth retaining grooves 67-1, 67-2, 67-3 and 67-4 which open to a lower portion of the cable holder 67 to hold the first, second, third, and fourth output cables 61,62,63 and 64 respectively.

The cable holder 67 has a pair of hooks 672 extending upwardly at both ends of the cable holder 67. Meanwhile, the main circuit board 51 has a pair of engaging holes 512 with which the pair of the hooks 672 engages. Therefore, the pair of the hooks 672 engages with the pair of the engaging holes 512, and thus the cable holder 67 is mounted on the bottom surface 51*f* of the main circuit 51 by the engagement.

The cable holder 67 has a locating rug 674 extending downwardly at one end of the cable holder 67. The ground plane 55 has a locating hole 522 into which the locating rug 674 fits. Thus, the locating rug 674 fits into the locating hole 522 and thus the cable holder 67 is positioned on the ground plane 55.

A coating of the third output cable 63 is peeled away at a position where is substantively $\lambda/4$ away from the first grounded portion 81 and the external conductor of the third output cable 63 exposes.

In the compound antenna apparatus 50, the plate spring 82*a* is wounded around the exposed portion of the external conductor of the third output cable 63, and the plate spring 82*a* is fixed on the main circuit board 51 together with the third output cable 63 by means of a screw. Thus, third output cable 63 is electrically connected and grounded to the ground pattern formed on the bottom surface of the main circuit board 51.

The plate spring 82*a* has a cylindrical portion 821 and an attaching portion 822. The cylindrical portion 821 is wounded around the exposed external conductor of the third output cable 63 to be electrically connected. The attaching portion 822 extends from the cylindrical portion 821 and is used for fixing and connecting the plate spring 82*a* to the ground plane 55 by means of the screw 101. In other words, the attaching portion 822 is attached between the cable holder 67 and the ground plane 55 by means of the screw 101. The ground plane 55 is provided with internal threads for threadedly engaging with the screw 101 and has a burring hole 554 protruding upwardly. In other words, the burring hole 554 protrudes toward the main circuit board 51. The attaching portion 822 of the plate spring 82*a* has a cylindrical protrusion 822*a* protruding upwardly so as to cover an outer peripheral wall of the burring hole 544. The main circuit board 51 has a through hole 514 for penetrating a threaded portion of the screw 101 and the cable holder 67 also has a through hole 676 for penetrating the threaded portion of the screw 101.

In the fixation structure of the second grounded portion of the third output cable 63 described above, the screw 101 is threadedly engaged with the burring hole 554 of the ground plane 55 penetrating the through hole 514 of the main circuit board 51 and the through hole 676 of the cable holder 67, and thus the attaching portion 822 of the plate spring 82*a* is fixed and electrically connected to the ground plane 55. At that time, the protrusion of the burring hole 554 and the cylindrical protrusion 822*a* of the attaching portion 822 closely contact with each other and the third output cable 63 and the plate spring 82*a* are tightened.

In the compound antenna apparatus 50, the caulking process and the thread fastening process are performed simultaneously in one process by threadedly engaging with the screw 101 to reduce the assembling process. Further, the cylindrical protrusion 822*a* is provided at the plate spring 82*a*. More specifically, the cylindrical protrusion 822*a* is provided at a position which corresponds to the burring hole (threaded hole) 554 provided at the ground plane 55. Thus, it is possible to ground the exposed external conductor of the third output cable 63 without depending on variations of geometrical tolerance and dimensional tolerance.

Figure 7:
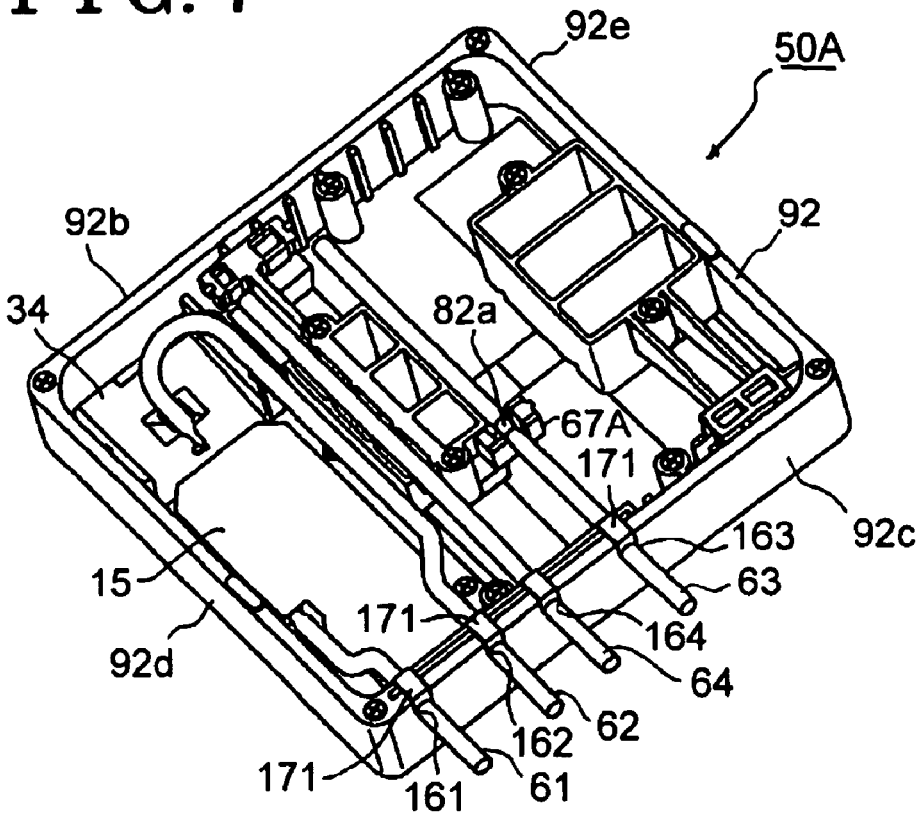
FIG. 7 is an view illustrating an embodiment of another compound antenna apparatus to which the present invention is applied to and viewed from the bottom side.

Another compound antenna apparatus 50A to which the invention is applied will be described below. FIG. 7 is a perspective view of the compound antenna apparatus 50A from which the bottom case 91 and the ground plane 55 is removed and viewed from the bottom surface side.

Identical numerals are given to the components which have the identical functions to the compound antenna apparatus 50 illustrated in FIGS. 1 and 2 and only different points will be described in detail for simplification of the description.

Similarly to the top case 92 shown in FIG. 2, the first, second, third, fourth openings 161, 162, 163 and 164 are formed for pulling out the corresponding output cables 61,62, 63 and 64 to the exterior portion of the top case.

Figure 8:
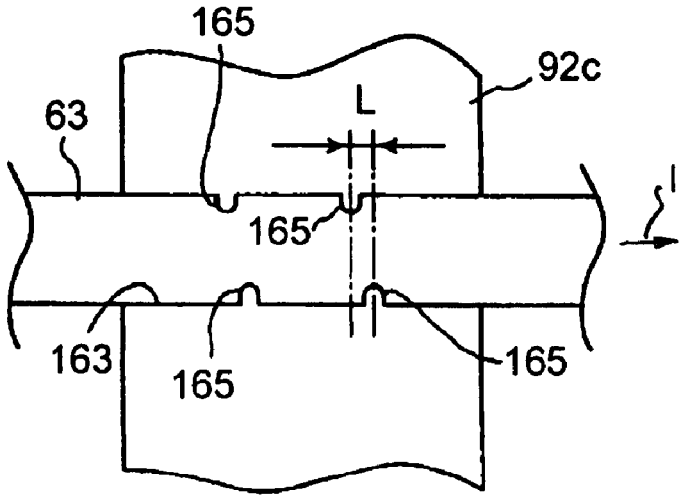
FIG. 8 is a plain view illustrating a holding portion of the top case where an output cables is held.

FIG. 8 is a view illustrating the state wherein the third output cable 63 is fitted into the third opening 163 of the second case wall portion 92*c*. A plurality of ribs 165 are formed at opening areas of the third output opening 163, which face each other and the ribs 165 protrude from the opening areas. As illustrated in FIG. 8, the third output cable 63 is fitted into the third opening 163 and the third output cable 63 is held by sandwiching the third output cable 63 with the plural ribs 165.

Figure 5:
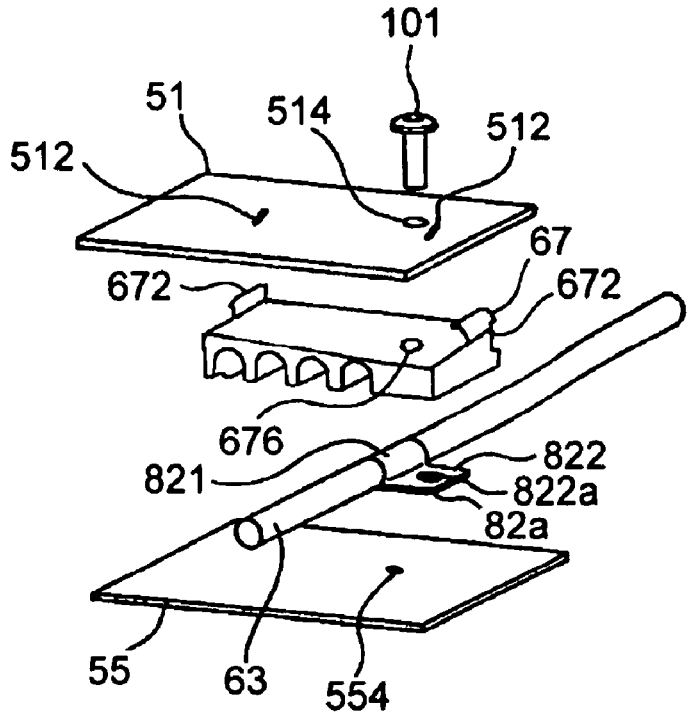
FIG. 5 is a perspective view illustrating an antenna holder shown in FIGS. 4A to 4G having a feed element and a passive element.
Figure 6:
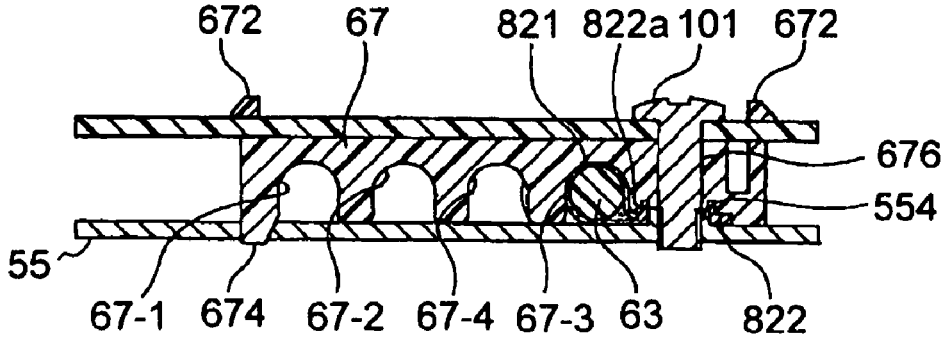
FIG. 6 is a sectional view illustrating the antenna holder shown in FIG. 5 having the feed element and the passive element and viewed from the bottom side.

Similarly to the output cable 63 shown in FIG. 5, the output cable 63 is held by a cable holder 67A and the third output cable 63 and the plate spring 82*a* are tightened. As illustrated in FIG. 8, the ribs 165 formed at one side of the opening area and the ribs formed at the other side of the opening area are arranged so as to have a phase difference L therebetween for improvement of the tensile strength against the pull-out force acting in a direction I. The direction I corresponds to an axial direction of the output cable 63 and the direction in which the output cable 63 is pulled out of the top case 92.

Although the illustrations are not shown, the ribs 165 are formed at the opening areas of the first, second, and fourth openings of the second case wall 92*c* so that the output cables 61, 62 and 64 can be respectively fitted in the first, second and fourth openings 161, 162 and 164. The ribs 165 protrude from the respective opening areas facing each other.

Thus, the output cables 61,62, and 64 are fitted into the first, second, fourth openings 161,162, and 164 respectively and the output cable 63 is held by being sandwiched with the ribs 165.

Further, retaining members 171 are fitted into the first, second, third, and fourth openings 161, 162, 163 and 164 respectively. The retaining members 171 pushes the output cables 61, 62, 63 and 64 to fit the cables into predetermined positions and holds the output cables thereon. The retaining members 171 may be respectively fitted into the first, second, third, and fourth openings 161, 162, 163, and 164 by press fitting. Alternatively, the retaining members 171 may be respectively fixed to the opening areas of the first, second, third, and fourth opening 161, 162, 163, and 164 by bonding with an adhesive.

Figure 9:
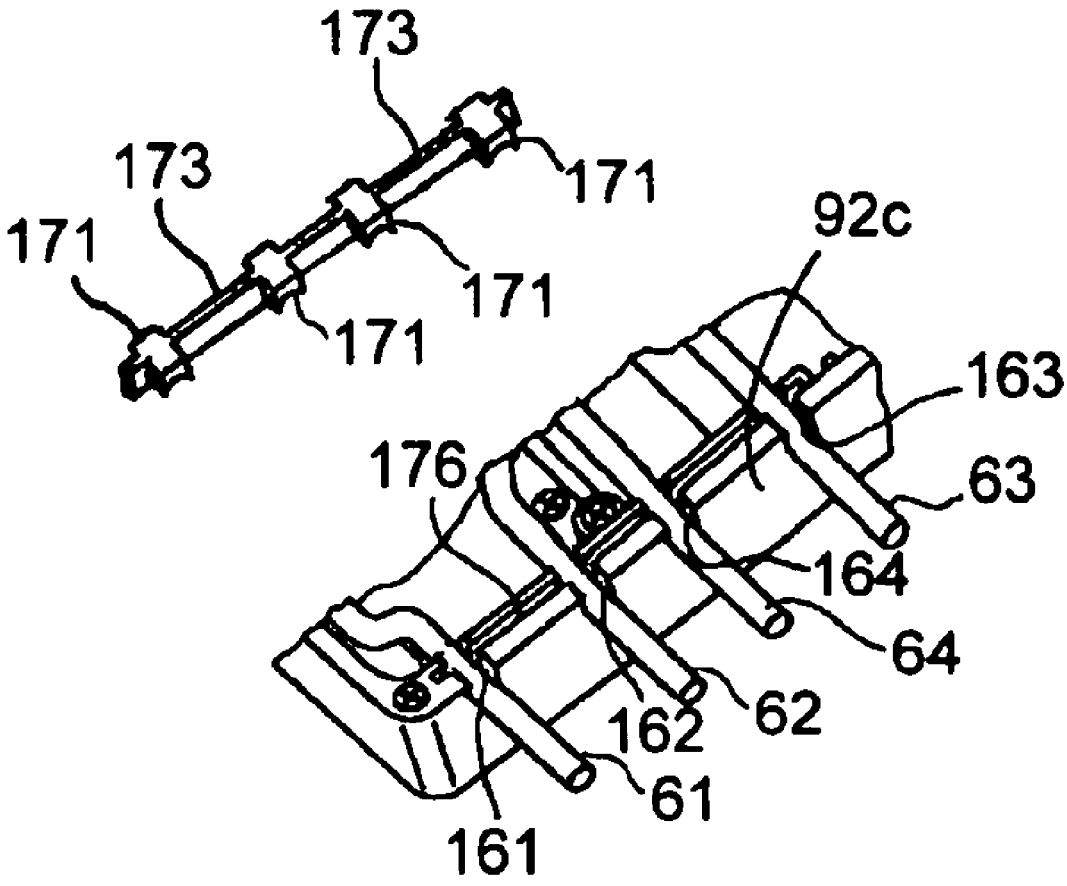
FIG. 9 is a perspective view illustrating another example of the holding portion of the top case where the output cables are held.

FIG. 9 is a view illustrating an example wherein four retaining members 171 are integrally formed with a plate material 173. The plate material 173 is fitted into a groove 176 which is formed so as to face an inner surface of the second case wall portion 92*c* and thereby simultaneously fits the four retaining members 171 into the first, second, third, and fourth openings 161, 162, 163, and 164.

The preferred embodiment has been described above, however, the present invention is not limited to the above embodiment. For example, it is possible to hold the cables by forming the opening depending on the number of the output cables even if the number of the output cables increases or decreases in the embodiment described above.

Obviously, the number and the form (length) of the ribs vary depending on the diameter of the cable. Thus, it is possible to apply the invention even if the number and the form of the ribs are different.

In the compound antenna apparatus of the invention, the plural openings are formed in the top case. The plural ribs are formed at each opening area of the openings and protrude from the opening areas. Each cable is sandwiched by the ribs and thus, it is possible to improve the tensile strength of the cables.

Further, the lock bands and the brackets are not required to hold the cables in the compound antenna apparatus of the present invention. Hence, it is possible to reduce the number of the components and the man-hours and save space.

The invention claimed is:

1. A compound antenna apparatus comprising:

a plurality of antenna units;

a top case covering the antenna units; and a cable connected to one of the antenna units and led out of the top case, wherein the top case includes:

a case main surface;

a case wall portion standing in the vicinity of an edge of the case main surface; and an opening formed by cutting an edge of the case wall portion so that the cable is pulled out to an exterior portion of the top case through the opening, and the opening having one surface and the other surface that face each other, a first rib and a second rib respectively formed and protruding at the surface and the other surface of the opening so as to sandwich the cable.

2. A compound antenna apparatus according to claim 1, wherein the first and second ribs are arranged so as to have a phase difference in an axial direction of the cable which is identical to the direction in which the cable is pulled out of the top case.

3. A compound antenna apparatus according to claim 1, wherein a retaining member is attached to the opening and is used for pushing the cable so as to fit the cable into a predetermined position of the opening and holding the cable at the predetermined position.

4. A compound antenna apparatus according to claim 2, wherein a retaining member is attached to the opening and is used for pushing the cable so as to fit the cable into a predetermined position of the opening and holding the cable at the predetermined position.

5. A compound antenna apparatus according to claim 3, wherein the retaining member is integrally formed with a plate member and fitted into a groove formed so as to face an inner surface of the case wall portion.

6. A compound antenna apparatus according to claim 4, wherein the retaining member is integrally formed with a plate member and fitted into a groove formed so as to face an inner surface of the case wall portion.

7. A compound antenna apparatus according to claim 1, wherein the cable is disposed between a main circuit board and a ground plane, the ground plane is provided with a cable holder thereon, and the cable holder holds the cable.

8. A compound antenna apparatus according to claim 2, wherein the cable is disposed between a main circuit board and a ground plane, the ground plane is provided with a cable holder thereon, and the cable holder holds the cable.

9. A compound antenna apparatus according to claim 3, wherein the cable is disposed between a main circuit board and a ground plane, the ground plane is provided with a cable holder thereon, and the cable holder holds the cable.

10. A compound antenna apparatus according to claim 4, wherein the cable is disposed between a main circuit board and a ground plane, the ground plane is provided with a cable holder thereon, and the cable holder holds the cable.

11. A compound antenna apparatus according to claim 5, wherein the cable is disposed between a main circuit board and a ground plane, the ground plane is provided with a cable holder thereon, and the cable holder holds the cable.

12. A compound antenna apparatus according to claim 6, wherein the cable is disposed between a main circuit board and a ground plane, the ground plane is provided with a cable holder thereon, and the cable holder holds the cable.

* * * * *